United States Patent [19]

Edeus et al.

[11] 4,021,988

[45] May 10, 1977

[54] METAL FRAME CONSTRUCTION

[75] Inventors: James A. Edeus, Rock Falls; James R. Johnston, Sterling, both of Ill.

[73] Assignee: National Manufacturing Company, Sterling, Ill.

[22] Filed: June 16, 1976

[21] Appl. No.: 696,783

[52] U.S. Cl. ..... 52/656; 403/274

[51] Int. Cl.[2] ..... E06B 3/04

[58] Field of Search ..... 52/664, 474, 656, 211, 52/215, 216, 217, 758 R, 758 H, 758 A, 455, 456; 403/242, 274, 264; 49/504

[56] References Cited

UNITED STATES PATENTS

| | | | |
|---|---|---|---|
| 1,220,163 | 3/1917 | Anderson | 52/758 H |
| 2,632,928 | 3/1953 | Kaufman | 52/455 |

FOREIGN PATENTS OR APPLICATIONS

| | | | |
|---|---|---|---|
| 1,411,743 | 8/1965 | France | 49/504 |
| 992,227 | 5/1965 | United Kingdom | 211/187 |

*Primary Examiner*—John E. Murtagh
*Attorney, Agent, or Firm*—Edmond T. Patnaude

[57] ABSTRACT

A metal door frame is fabricated in the field by interfitting channel cross pieces in channel uprights and curling prepunched tongues in the uprights through openings in the cross pieces to square-up and to secure the cross pieces to the uprights.

6 Claims, 4 Drawing Figures

METAL FRAME CONSTRUCTION

The present invention relates in general to metal structural frames, and it relates in particular to a new and improved method of fabricating such frames and also to a new and improved frame construction.

BACKGROUND OF THE INVENTION

In the on site erection of metal buildings such, for example, as those having corrugated metal siding, the siding is attached to structural frames. The sliding doors for such buildings have heretofore employed wood or metal frames to which the siding panels are fastened.

In accordance with the prevailing practice the frames are constructed of prefabricated parts which are assembled at the erection site. The prior art frames, whether wood or metal, have several disadvantages. The wood frames are heavy and subject to warpage, do not remain square, and the fasteners used to attach the frame pieces together generally protrude from the door. These frames also require considerable time and expertise to assemble resulting in very expensive doors.

There are two types of metal frames in general usage, one being fabricated of extruded aluminum pieces and the other being fabricated of heavy gauge steel. Both of these types of frames are expensive. The steel frames are very heavy and thus difficult to operate while the lighter aluminum frames have poor strength characteristics.

SUMMARY OF THE INVENTION

Briefly, there is provided in accordance with the present invention a novel metal frame construction and method of fabricating the frame. The frame is preferably formed of relatively thin gauge steel channels having prepunched tongues and holes which enable one person to square up and to interconnect the frame pieces without the use of special tools. No separate fasteners are required to interconnect the frame pieces. Therefore, in order to assemble the frame, it is merely necessary to arrange the frame pieces in substantially the finally desired position and then, with a screw driver, press the tongues in the uprights through the openings in the cross members to square up the frame and to secure the frame pieces together. A door frame of this novel construction is relatively light in weight, is structurally strong and rigid, and has no protruding fasteners which might interfere with the attachment thereto of the siding or hardware for hanging the door.

BRIEF DESCRIPTION OF THE DRAWINGS

Further objects and advantages and a better understanding of the present invention can be had by reference to the following detailed description, wherein.

DETAILED DESCRIPTION OF THE INVENTION

Figure 1:
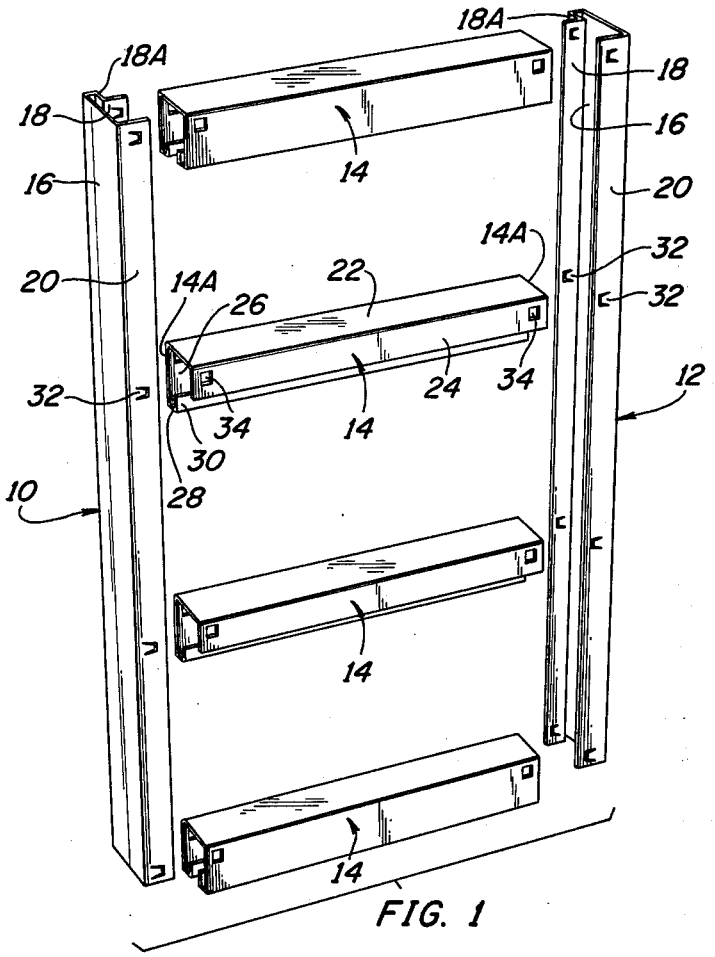
FIG. 1 is an exploded perspective view of the parts of my novel door frame prior to assembly.

Referring to FIG. 1, the parts of a structural metal frame of a type suitable for use in a sliding door, for example, consists of two upright members 10 and 12 and a plurality of cross members 14. The upright members and the cross members are all of channel-like construction. The parts are illustrated in FIG. 1 with the front or normally outside surface of the frame being at the rear.

The uprights 10 and 12 each includes a web portion 16 and a pair of spaced apart parallel side flanges 18 and 20. The flanges 18 have a stepped configuration at 18A in proximity to the web 16 to provide a recess on the outside of the frame to receive sheets of suitable siding material. If desired, however, the uprights may be simple C-shaped channels.

Each of the cross members 14 has a web portion 22 and depending spaced apart parallel side flanges 24 and 26. In the intermediate cross members 14, the flange 26 against which the siding sheet is to be mounted has a greater vertical dimension than does the flange 24 and, in addition, it has a reentrant flange 28 at the bottom which terminates in a upstanding vertical lip 30. The top and bottom cross members 14 are complete channels which are symmetrical about the respective central vertical planes. As shown in FIG. 1, the bottom cross member 14 extends below the uprights to accommodate a guide system which may be located therein if desired for slidably guiding the door between open and closed positions. The large facial areas of the flanges 26 provide rigid surfaces of substantial size against which the siding may be fastened with suitable sheet metal screws, nails, pop-rivets or the like.

Figure 2:
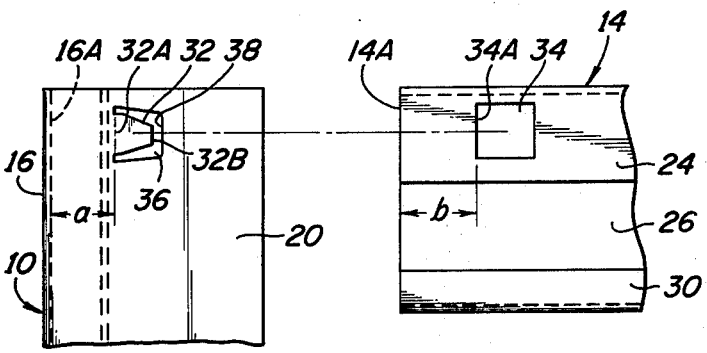
FIG. 2 is an enlarged, fragmentary view illustrating the relative positions of the tongues and openings used to fasten the cross members to the uprights.

A plurality of integral tongues 32 are die-cut in the flanges 18 and 20 of the uprights 10 and 12, and a plurality of openings 34 are punched out of the flanges 24 and 26 of the cross members 14. As best shown in FIG. 2, the base 32A of each tongue 32 is spaced from the inner surface 16A of the associated web 16 by a distance *a*. Each opening 34 has a vertical end edge 34A which is spaced from the adjacent end 14A of the respective cross member by a distance *b*. It is important that the ends 14A be cut square and perpendicular to the longitudinal axis of the respective member 14 and that the distance *b* be greater than the distance *a*.

Figure 3:
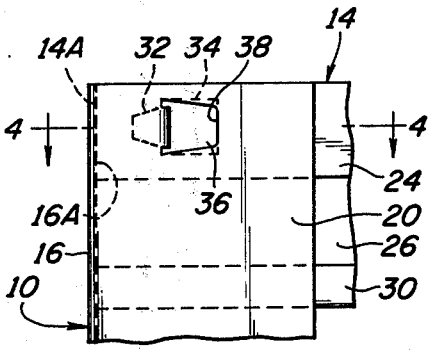
FIG. 3 is a fragmentary view showing the connection between one cross member and one upright.
Figure 4:
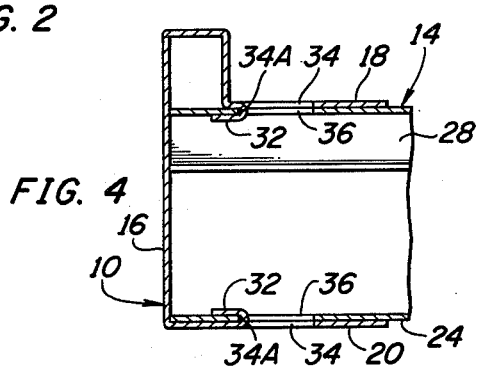
FIG. 4 is a cross sectional view taken along the line 4—4 of FIG. 3.

With reference to FIGS. 3 and 4, it may be seen that with a cross member 14 inserted between the flanges 19 and 20, the tongues 32 are opposite the openings 34 which have a greater area than the tongues. Accordingly, the tongues may be pressed into the adjacent openings 34 and curled under the edges 34A to force the end 14A tightly against the inner web surface 16A of the upright. It may also be seen that the external width of each cross member 14 is less than the distance between the flanges 18 and 20 of the upright so that a relatively tight fit is provided between the cross members and the uprights prior to interconnecting the same. The operation of curling the tongues 32 under the flanges 24 and 26 of the cross members squares the cross members relative to the uprights and also fixedly locks the parts together. With this construction there is no fastening means which may loosen due to vibration of the frame caused by wind and the like.

As best shown in FIG. 2, each tongue 32 is surrounded on three sides by a generally C-shaped opening 36. This opening 36 enables the person assembling the frame to insert a screw driver blade between the distal end 32B of the tongue and the adjacent edge 38 of the opening 36 and to then exert a prying force on the screw driver to curl the tongue 32 under the edge 34A. In this operation the edge 38 provides the fulcrum about which the screw driver is pivoted.

It may thus be seen that the present invention enables on site fabrication of structural metal frames. The frames can be assembled on the ground or other surface by inserting the ends of the cross members between the side flanges of the uprights into the approximately desired final positions and then curling the tongues 32 through the holes 34. The tongues 32 and the holes 34 are prepunched and die cut at the factory whereby their positions are predetermined and equally spaced as shown, for example, in FIG. 1. The resulting frame is strong and durable, and the exterior surface are planar with no protruding fasteners or the like. No special tools or expertise are required to fabricate the frame in the field, and the cost is relatively low from the points of view of both parts and labor.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A metal door frame, comprising first and second upright channel members each having a web and two parallel side flanges, a plurality of cross channel members each having a web and two parallel side flanges, said upright channel members being disposed in mutually parallel relationship, said cross channel members being respectively disposed in perpendicular relationship to said upright channel members, the end portions of said cross channel members being disposed within respective ones of said upright channel members abutting the webs of said upright channel members and with the faces of the adjacent said flanges of said upright and cross channel members being in mutual engagement, said upright channel members each having a plurality of tongue portions integral with said side flanges and extending through respective openings in the adjacent ones of said side flanges of said cross channel members, said tongue portions being curled under said side flanges of said cross channel members to secure said cross members to said upright members and to hold the ends of said cross channel members in abutment with the webs of said upright members.

2. A metal door frame according to claim 1 wherein said webs and said side flanges of each of said cross channel members terminate at the respective ends in planes which are perpendicular to the longitudinal axis of the channel member.

3. A metal door frame according to claim 1 wherein two of said openings are provided near each end of said cross-channel members, said two openings being respectively provided in the side flanges of the respective cross-channel member, and two of said tongue portions are respectively provided in the side flanges of the associated upright channel member, respectively extend through said two openings and are curled under the side flanges of the cross-channel member.

4. A metal door frame according to claim 1 wherein said tongue portions are respectively connected to an intermediate portion of each associated flange.

5. A metal door frame according to claim 1 wherein said openings are defined in part by an edge spaced from the adjacent end of the respective cross channel member by a first distance, and said tongue portions are connected to said flanges along lines spaced from the webs of the respective upright channel members by a second distance, said first distance being no less than said second distance.

6. A metal door frame according to claim 5 wherein said openings each have a cross sectional area greater than the cross sectional area of each of said tongues.

* * * * *